US008479356B2

(12) United States Patent
Sauer et al.

(10) Patent No.: US 8,479,356 B2
(45) Date of Patent: Jul. 9, 2013

(54) VACUUM CLEANER FILTER BAG COMPRISING A SEALING DEVICE

(75) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 779 days.

(21) Appl. No.: 12/094,046

(22) PCT Filed: Nov. 22, 2006

(86) PCT No.: PCT/EP2006/011190

§ 371 (c)(1),
(2), (4) Date: Sep. 9, 2010

(87) PCT Pub. No.: WO2007/059938

PCT Pub. Date: May 31, 2007

(65) Prior Publication Data

US 2010/0325833 A1 Dec. 30, 2010

(30) Foreign Application Priority Data

| | | |
|---|---|---|
| Nov. 22, 2005 | (EP) | 05025480 |
| Nov. 28, 2005 | (EP) | 05025904 |
| Dec. 9, 2005 | (EP) | 05027013 |
| Dec. 13, 2005 | (EP) | 05027219 |

(51) Int. Cl.
*A47L 9/14* (2006.01)

(52) U.S. Cl.
USPC ..... 15/347; 15/DIG. 8; 55/361; 55/373; 55/376; 55/377

(58) Field of Classification Search
USPC ..... 15/347–353, DIG. 8; 55/361, 373, 55/376, 377
IPC ..... A47L 9/14
See application file for complete search history.

(56) References Cited

U.S. PATENT DOCUMENTS 3,276,192 A 10/1966 Fesco

FOREIGN PATENT DOCUMENTS

| | | |
|---|---|---|
| BE | 529 649 | 7/1954 |
| CH | 571339 | 1/1976 |
| CN | 1 327 374 A | 8/2004 |
| DE | 28 40 628 A1 | 3/1979 |
| DE | 81 32 813 U1 | 7/1982 |

(Continued)

OTHER PUBLICATIONS

International Search Report for International Application No. PCT/EP2006/011190 completed Mar. 15, 2007.

(Continued)

*Primary Examiner* — David Redding
(74) *Attorney, Agent, or Firm* — Brinks Hofer Gilson & Lione

(57) ABSTRACT

The present invention relates to a vacuum cleaner filter bag comprising an inlet opening, a retaining plate, which is situated on the exterior of the bag in the vicinity of the inlet opening and can be attached to a retaining device of a vacuum cleaner in order to fix the vacuum cleaner filter bag, and a closing device situated in the vicinity of the inlet opening, which is configured in such a way that it adopts a first position when the retaining plate is not attached to the retaining device and a second position by the attachment of the retaining plate to the retaining device, wherein the inlet opening is closed in the first position of the closing device and is open in the second position of the closing device.

26 Claims, 3 Drawing Sheets

FOREIGN PATENT DOCUMENTS

| | | | |
|---|---|---|---|
| DE | 88 01 638.2 | U1 | 7/1989 |
| DE | 90 16 939.5 | U1 | 5/1991 |
| DE | 91 01 981 | U1 | 6/1991 |
| DE | 199 48 909 | A1 | 4/2001 |
| DE | 20 316 574 | | 2/2004 |
| EP | 0 361 240 | A1 | 4/1990 |
| EP | 0 499 168 | A1 | 8/1992 |
| EP | 0 960 645 | A2 | 12/1999 |
| GB | 1 221 323 | | 2/1971 |
| WO | WO 98/17164 | A1 | 4/1998 |
| WO | WO 98/38900 | A1 | 9/1998 |
| WO | WO 01/26526 | A1 | 4/2001 |
| WO | WO 03/073903 | A1 | 9/2003 |

OTHER PUBLICATIONS

Official Action dated Sep. 15, 2009 for Russian Application No. 2008121241 (with translation).

VACUUM CLEANER FILTER BAG COMPRISING A SEALING DEVICE

This application claims the benefit under 35 U.S.C. §371 of International Application No. PCT/EP2006/011190, filed Nov. 22, 2006, which claims the benefit of European Application Nos. 05025480.4, filed Nov. 22, 2005; 05025904.3, filed Nov. 28, 2005; 05027013.1, filed Dec. 9, 2005; and 05027219.4, filed Dec. 13, 2005. These references are incorporated herein in their entirety.

The present invention relates to vacuum cleaner filter bag with an improved closing device.

Closing elements are provided in vacuum cleaner filter bags for closing such bags, especially when a filled bag is disposed off, so that the dust contained therein cannot escape.

The prior art discloses various variants for closing a vacuum cleaner filter bag.

EP 0 499 168 describes a holding plate and a closure plate that are constructed as an integral molding. The opening in the holding plate is closed by displacing the closure plate that is connected via slats to the holding plate.

DE 203 16 574 discloses a connecting piece comprising a closure plate guided in a displaceable way. The closure plate must be pulled by hand into the closing position.

A further holding plate with a separate closing element is known from WO 98/38900.

Said vacuum cleaner filter bags have the drawback that the closing mechanisms for achieving appropriate tightness are complicated in terms of manufacture.

WO 01/26526 discloses a filter bag with a retaining plate in which a through opening can be closed by means of a closing member. The closing member comprises a click spring. The drawback of this filter bag is that a complicated opening mechanism must be provided at the vacuum cleaner side. Furthermore, the click spring must be manufactured with high precision as far as camber and material are concerned in order to achieve a desired spring characteristic which provides for an adequate closing force and permits, on the other hand, a large opening angle during operation.

It is the object of the present invention to provide a vacuum cleaner filter bag with a simple and reliable closing device in the light of the bags known from the prior art.

This object is achieved by a vacuum cleaner filter bag according to claim 1.

Hence, according to the invention a vacuum cleaner filter bag is provided comprising an inlet opening, a retaining plate, which is situated on the exterior of the bag in the vicinity of the inlet opening and can be attached to a retaining device of a vacuum cleaner in order to fix the vacuum cleaner filter bag, and a closing device situated in the vicinity of the inlet opening, which is configured in such a way that it adopts a first position when the vacuum cleaner filter bag is not inserted in the vacuum cleaner, and that it can be brought into a second position when the vacuum cleaner filter bag is inserted in the vacuum cleaner, wherein the inlet opening is closed in the first position of the closing device and is open in the second position of the closing device.

When the retaining device is fixedly mounted in the vacuum cleaner, the closing device can already be moved into the second position when the retaining plate is mounted on the retaining device, and it can thereby be opened. Upon removal from the retaining device the closing device is again returned into its first position.

When the retaining device is mounted on the vacuum cleaner in a movable way, e.g. by means of a hinge, so as to facilitate the changing of a vacuum cleaner bag by folding the retaining device out of the vacuum cleaner, the closing device can be brought into the second position when the retaining device is brought into the position it adopts during operation of the vacuum cleaner. When the retaining device is folded out of the vacuum cleaner for removing the vacuum cleaner bag, the closing device is automatically closed.

As an alternative, the closing device may also be brought into the second position, i.e. opened, by an element provided at the vacuum cleaner side, and again be brought into the first position, i.e. closed, by said element. This alternative offers the advantage that the closing device has only to be opened during the sucking operation proper. This has on the one hand the consequence that dust cannot fall out of the bag when the vacuum cleaner is in the inoperative condition. On the other hand, the closing device, which is always under mechanical stress in its second opened position, is less stressed.

The closing mechanism is simple because the closing device seals the inlet opening as a rule when the vacuum cleaner filter bag is not arranged in the vacuum cleaner. As long as the bag is not inserted in the vacuum cleaner, the closed inlet opening further permits the provision of particles present in bulk form in the vacuum cleaner filter bag, e.g. odor adsorbents. For the desired function the closing device must be dimensioned in particular in a suitable way and arranged in the interior of the bag.

According to an alternative the closing device can be arranged in the interior of the bag in the area of the inlet opening. Thanks to the closing device arranged in the interior of the bag a closing element is not needed on the retaining plate. Furthermore, the closing device can thus be connected in a particularly simple way to the bag wall.

The closing device can be fastened to the inside or the outside of the bag and surround the inlet opening at least in part. This accomplishes, in particular, a stable arrangement of the closing device.

According to another alternative the closing device may be arranged on the retaining plate. In this alternative, the combination of retaining plate and closing device can first be formed during manufacture, and the combination is then connected to the wall of the bag. For this purpose known methods can be employed for fastening retaining plates to bags.

In this alternative, the closing device is fastened to the side of the retaining plate facing the outside of the bag and surrounds the inlet opening at least in part. This also yields a stable arrangement of the closing device.

The closing device of the described vacuum cleaner filter bag may comprise a spring element which exerts a restoring force on part of the closing device in such a manner that the closing device adopts the first position when the retaining plate is not mounted on the retaining device.

Such a spring element permits a safe closing of the inlet opening in a simple way, particularly when the vacuum cleaner filter bag is removed from the vacuum cleaner.

The closing device may particularly comprise fold lines or film hinges so that the closing device can be brought from the first position or second position into the second position or first position. With such fold lines the closing device can be brought from the one into the other position in an easy and reliable way.

The closing device of the above-described vacuum cleaner filter bag can be configured such that in the first position it has an extension reduced in size in comparison with the second position in a direction perpendicular to the plane of the inlet opening.

This means that the closing device is foldable or collapsible. Thanks to the smaller extension in the second position the vacuum cleaner filter bag can be given a very compact shape, particularly before use. This is of particular advantage to flat bags, which can thus be folded for packaging purposes into specific sizes. Thanks to such collapsible closing devices a situation can be avoided where the thickness of the collapsed bag is considerably increased. Preferably, the closing device is given a substantially flat shape in the second position.

The above-described vacuum cleaner filter bags may further comprise at least one sealing element, particularly for sealing the inlet opening. With such a sealing element, the inlet opening, in particular, can be sealed around an introduced nozzle or pipe on the one hand. On the other hand, a sealing element may be configured for sealing the inlet opening in the first position of the closing device.

The at least one sealing element can be arranged between the inlet opening and the closing device and/or within the closing device. With a suitable selection of the arrangement of the at least one sealing element the inlet opening can be closed in an optimum way in the first position of the closing element.

The material of the sealing element may comprise rubber, an elastomer, a foil or foam, particularly closed-cell foam.

The closing device of the above-described vacuum cleaner filter bag may comprise a substantially airtight material.

The material of the closing device may comprise a plastic material, a dry-laid or wet-laid nonwoven or paper, particularly cardboard, or a foil. Other materials are also possible. In particular, an adequate stiffness of the material is of advantage so that the closing device is not excessively moved by the air stream during operation. The material of the closing device may particularly be identical with the material of the retaining plate; for instance, the closing device and the retaining plate may be configured as an integral injection-molded part.

The closing device may be glued or welded to the filter material of the vacuum cleaner filter bag wall and/or the retaining plate. For instance, the closing device may comprise polyethylene or polypropylene or may be coated therewith at connections points with the inside of the bag. This permits a fastening of the closing device and of a retaining plate comprising said materials by means of ultrasonic welding to the filter material of the bag wall at the same time.

In a development of the said vacuum cleaner filter bag the closing device in the second position may comprise at least one closing surface opposite the inlet opening. Such a closing surface will then close the inlet opening in a suitable way upon "collapsing" of the closing device in the case of which the first position is adopted.

In a development the at least one closing surface may be arranged at a predetermined angle relative to the plane of the inlet opening particularly in parallel with the plane of the inlet opening.

With a suitable selection of the angle the closing device can be adapted to different parameters, such as bag geometry or dimensions, inflow angle of an air stream, during operation and can be optimized. A closing surface opposite the inlet opening may particularly have a distance or an average distance of between 0.5 cm and 5 cm, particularly between 2.5 cm and 4 cm, from said opening.

The at least one closing surface may have an area larger than the area of the inlet opening. This ensures a reliable and tight closing of the inlet opening. Each closing surface may have an area of 15 to 100 $cm^2$, particularly 40 to 60 $cm^2$.

According to a development of the above-described vacuum cleaner filter bag, the closing device in the second position may comprise two trapezoidal or rectangular closing surfaces which, starting from the inlet opening, converge towards each other in the manner of a wedge and are interconnected at a connection edge opposite the inlet opening.

In a development of the above-described vacuum cleaner filter bag the closing device in the second position may have the shape of a parallelepiped, particularly of a cuboid, which comprises an inflow opening in a first side surface surrounding the inlet opening and connected to the inside of the bag, and comprises an outflow opening in at least one further side surface standing on the first side surface.

The parallelepiped form achieves a stable construction of the closing device, with a suitable closing surface being simultaneously formed by the side surface of the parallelepiped opposite the inflow opening.

Each outflow opening, in particular, can occupy the whole side surface of the parallelepiped. This avoids a situation where dust particles sucked in at a corner of the parallelepiped accumulate.

To be more specific, at least two outflow openings that are opposite each other may be provided. These at least two opposite outflow openings have the effect that an inflowing air stream can flow in a homogeneous manner into the vacuum cleaner filter bag out of the closing device.

In a development of the above-described vacuum cleaner filter bag the closing device may be configured such that an air stream entering through the inlet opening can be deflected into the second position.

It has been found that with a closing device, which also assumes the function of a deflection device in this way, it is possible to significantly increase the service life of a vacuum cleaner filter bag while maintaining excellent filter characteristics. It has particularly been found that the filter cake developing in a filter bag considerably contributes to the filtration behavior of the filter bag. With such a closing device an air stream entering through the inlet opening is deflected, so that the entrained particles are evenly distributed in the interior of the bag and a uniform distribution of the developing filter cake and thus an increased service life are thereby achieved.

Such a closing device further offers the advantage that the particles entrained in the air stream do not impinge in an unimpeded way and at a high speed on the bag wall opposite the inlet opening, thereby destroying the same.

Particularly, the closing device may be configured for dividing the air stream into at least two partial streams with different flow directions.

With such a division into two or more partial streams an even more homogeneous distribution of the filter cake is achieved. Moreover, the number of the particles per particle stream is reduced in comparison with the entering air stream, which reduces the loading of the bag walls by the individual partial streams.

Furthermore, the invention provides a vacuum cleaner for accommodating one of the above-described vacuum cleaner filter bags, in which vacuum cleaner a retaining device is arranged that is adapted to be mounted on the retaining plate of the vacuum cleaner filter bag, wherein the retaining device is configured and/or arranged in the housing such that the closing device of the vacuum cleaner filter bag adopts the second position by attaching the retaining plate to the retaining device. Moreover, a combination consisting of one of the above-described vacuum cleaner filter bags and of such a vacuum cleaner is also provided.

Such a vacuum cleaner permits an advantageous cooperation with the described vacuum cleaner filter bags.

In addition, a vacuum cleaner is provided comprising a retaining device for the retaining plate of a vacuum cleaner filter bag, wherein the vacuum cleaner filter bag comprises a closing device arranged in the area of the inlet opening, which is configured such that the inlet opening is closed in a first position of the closing device and is open in a second position, and comprising an opening device which is configured such that in a first position of the closing device it permits an adoption of its first position and cooperates in a second position with the closing device such that it adopts its second position.

Due to these two positions of the opening device the inlet opening of the vacuum cleaner filter bag is opened and closed in a suitable way.

Particularly, the opening device may be configured such that in the switched-off state of the vacuum cleaner it adopts its first position and adopts the second position when the vacuum cleaner is switched on. As a consequence, the bag is opened when the vacuum cleaner is switched on and is closed again when it is switched off. In particular, this prevents particles present in the bag from exiting as long as the bag is not in operation.

Alternatively, the opening device may also be configured such that in the opened state of the vacuum cleaner filter bag compartment of the vacuum cleaner it adopts its first position and in the closed state of the vacuum cleaner filter bag compartment it adopts its second position.

Further features and advantages of the invention shall now be explained in more detail with reference to the embodiments illustrated in the figures, of which:

Figure 1:
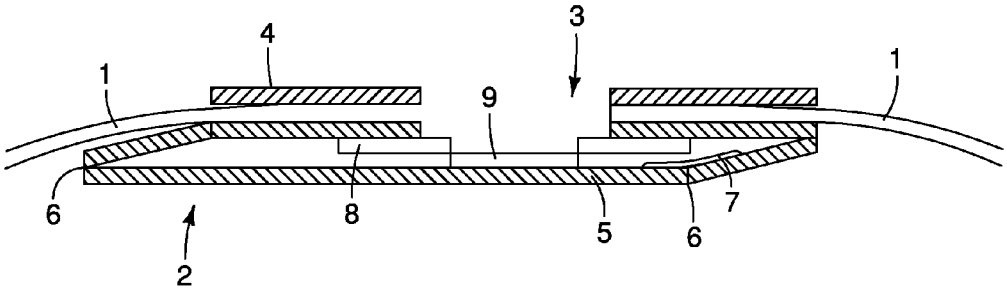
FIG. 1 is a schematic cross-sectional view through an embodiment of a closing device in the first position according to the present invention.

FIG. 1 schematically shows a cross-sectional view through an embodiment of a closing device according to the invention. In this figure the closing device assumes its second position in which, in comparison with the second position shown in FIG. 2, it has a smaller extension in a direction perpendicular to the plane of the inlet opening.

In the interior of a vacuum cleaner filter bag 1, a closing device 2 is arranged in the area of the (circular) inlet opening 3. A retaining plate 4 is provided on the outside on the vacuum cleaner filter bag.

In the illustrated example, the closing device 2 in its second position is shaped in the form of a cuboid. The base area 5 of said cuboid is arranged in parallel with the plane of the inlet opening 3. Said base area is the closing surface for the inlet opening.

A first sealing element 8 is arranged in the interior of the closing device. Said sealing element is provided around the whole inlet opening. This sealing element particularly accomplishes a suitable seal after introduction of a nozzle or pipe connected to the vacuum cleaner hose.

A further sealing element 9 is arranged on the base area 5 of the cuboid. Said sealing element serves to tightly seal the inlet opening in the first position of the closing device. The further sealing element 9 can particularly be adapted to the opening in the first sealing element 9.

For instance, the two sealing elements 8 and 9 can be produced by arranging a continuous sealing material, i.e. one covering the inlet opening, in the interior of the closing device. This may e.g. be closed-cell foam. Subsequently, in the area of the inlet opening an opening is punched out of the sealing material to expose an inflow opening in the cuboid. The punched-out material can then be arranged on the base area 5 of the cuboid, so that in the first position of the closing device it fits exactly into the opening in the sealing element 8. Prior to punching the material to be punched out may already be connected, particularly glued, to the base area. As a consequence, this material is already arranged at the right position after the punching operation.

Furthermore, in the illustrated embodiment a bending spring 7, which may e.g. be cambered, may be provided. Thanks to the resilient force a restoring force is exerted on the closing device, so that said device basically assumes its closed position shown in FIG. 1.

The bending spring 7 may e.g. be glued to the base area and the right side surface. The spring may also be arranged in a different way. For instance, the closing device 2 may be double-layered (for example with two layers of cardboard) at least in part, the spring being arranged between the two layers. The layers are glued to one another, with an unglued space being left for the spring; the spring itself need then not be glued to one of the layers; as an alternative, it may be firmly connected to one or both layers at one end only.

It should be emphasized that, depending on the type of spring 7 and/or the construction of the closing device, the sealing element 9 in the first position of the closing device can penetrate into the opening of the sealing element 8 to different degrees.

As an alternative to the bending spring, a permanent magnet may also be provided in or on the retaining plate 4, and a ferromagnetic element in or on one of the side surfaces or the base area 5. This also forms a readjusting device permitting a folding of the closing device.

Figure 2:
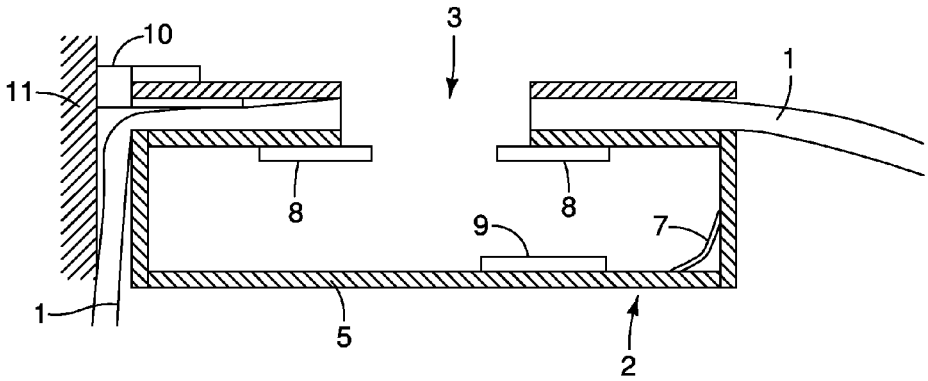
FIG. 2 is a schematic cross-sectional view through an embodiment of a closing device in the second position according to the present invention.
Figure 3:
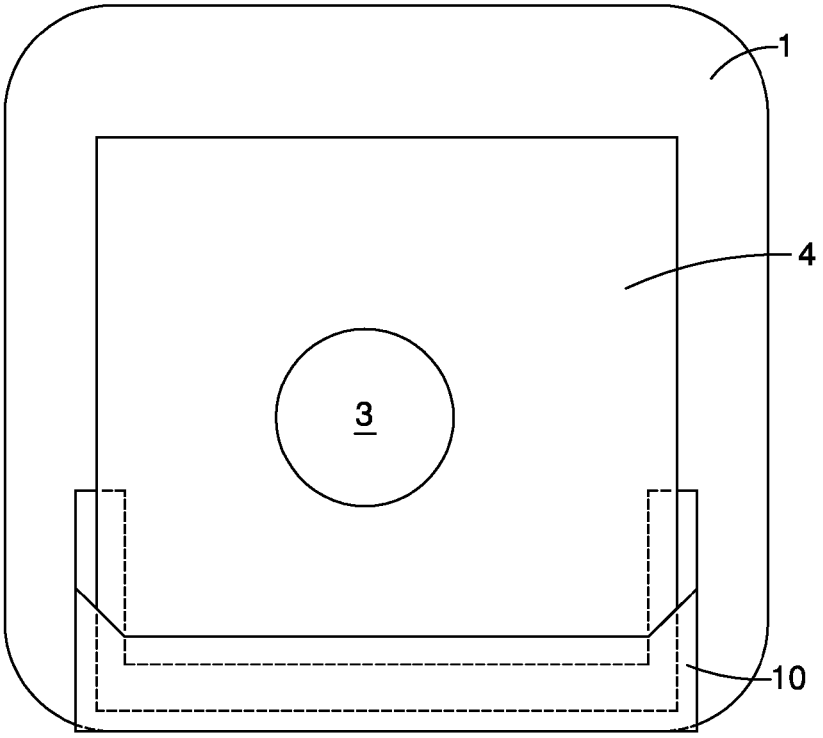
FIG. 3 is a schematic top view on a vacuum cleaner filter bag in a retaining device of a vacuum cleaner.

As can be seen in FIG. 2, the retaining plate 4 may be mounted on a retaining device 10 of a vacuum cleaner. A top view on such an arrangement is shown in FIG. 3. The retaining device 10 may particularly comprise an accommodation for the retaining plate 4.

When the retaining plate 4 is mounted on the retaining device 10, the closing device that is folded or collapsed in its first position (see FIG. 1) is folded to the right side (in the illustration of the figures), so that the closing device assumes its second position and the inlet opening is opened. In the example shown in FIG. 2, the vacuum cleaner filter bag 1 abuts on a surface 11 of the vacuum cleaner in such a manner that the closing device is moved against the resilient force of the bending spring to the right side, resulting in an unfolding of the closing device into its cuboid shape.

Hence, the closing device must be dimensioned and, particularly with respect to the retaining plate, must be arranged in the vacuum cleaner filter bag in such a manner that the second position can be assumed.

Owing to this construction the use of a spring with an exactly defined spring characteristic is not required. It is enough that it permits a first position and a second position; the force for unfolding the cuboid is applied by mounting the retaining plate on the retaining device. When the retaining plate is removed from the retaining device, the restoring force of the spring works such that the closing device is folded into its first position and closes the inlet opening.

Unfolding into the opened position can e.g. be accomplished by arranging the retaining device in the vacuum cleaner in an appropriate way, so that a corresponding area of the vacuum cleaner is available for unfolding operations, or through a corresponding configuration of the retaining device itself, so that an unfolding operation is only performed by said device. Furthermore, opening devices may also be provided in the vacuum cleaner for unfolding the closing device.

Furthermore, the base area 5 fulfills the function of a deflection surface or baffle plate. Two of the side surfaces perpendicular to the base area are each provided with an outflow opening (in the illustrated view at the front and at the rear), each occupying the whole side surface of the cuboid. The two other side surfaces (at the left and right side in the illustrated view) are closed. Hence, an air stream entering through the inlet opening 3 is divided into two partial streams that are deflected relative to the inflow opening by 90° and flow to the rear and front, respectively, into the bag. This deflection function accomplishes a homogeneous distribution of the filter cake, which increases the service life while maintaining excellent filter characteristics.

The dimensions of the cuboid deflection devices may e.g. be 7.5 cm×8 cm×3 cm (width×depth×height). The material may e.g. be cardboard.

The illustrated embodiment can be modified in many ways.

For instance, it is possible to provide an outflow opening only in one or three or all of the side surfaces of the cuboid. It is possible to select different dimensions and materials.

Furthermore, it is possible to provide only one sealing element arranged on the base area of the cuboid in such a manner that the inflow opening of the cuboid is sealed in the first position of the closing device. For this purpose it is possible to use, for instance, the piece of material punched out of the cover surface of the cuboid (opposite the base area), whereby the inflow opening is produced. During manufacture the inflow opening, in particular, may not be punched out completely, but a small material web may remain. When the cuboid form is shaped, e.g. by folding and gluing, the (partly) punched-out material piece is glued to the base area and the web is subsequently severed.

As an alternative, the base area may also be embossed such that an elevation projecting into the interior of the closing device is formed, whereby the inlet opening can also be sealed.

Furthermore, with the cuboid shape shown in FIG. 2, the cover surface may e.g. have an area larger than the base area. To be more specific, the cover area can project beyond the base area at the open sides, i.e. the sides with the outflow openings, by 2 to 3 mm. These additional areas can be folded downwards for sealing the open sides in the collapsed condition of the closing device.

The bag wall of the vacuum cleaner filter bag may e.g. have a structure as described in EP 0 960 645. To be more specific, a coarse filter layer, for instance of a meltblown, may be arranged in flow direction from the interior of the bag to the outside in front of a fine filter layer, e.g. also made of a meltblown. In addition, further layers may be provided in the filter structure, e.g. support layers and/or odor-absorbing layers.

In the illustrated example the closing device may be connected in different ways to the inside of the bag. According to one possibility the closing device is glued to the inner wall of the bag. As an alternative, the upper side of a closing device, which is e.g. made of cardboard, may be coated with PP (polypropylene), so that the closing device is welded to the bag wall at the same time when a PP retaining plate is welded by way of ultrasound.

As an alternative to the above-described cuboid shape, the closing device may also have a form shaped like or similar to a wedge.

The closing device may also be configured such that it does not fulfill any deflecting function. For instance, it may be configured as a closing plate which is pivotable about an axis arranged in a direction perpendicular to the plane of the inlet opening, which closing plate is pivoted away from the inlet opening when the retaining plate is mounted on a retaining device. A spiral spring may e.g. be provided as the spring element. In this variant the extension of the closing device remains substantially the same in both positions.

All of the embodiments described above with reference to FIGS. 1 to 3 can be modified according to a second constructional alternative in such a way that the closing device is not mounted on the inside of the bag in the area of the inlet opening, but the vacuum cleaner filter bag comprises a retaining plate for retaining the bag in a vacuum cleaner on which the closing device is arranged.

According to a first embodiment of this second constructional alternative a mounting opening must be provided in the bag wall for this purpose, the mounting opening being so large that the closing device fastened to the retaining plate can be introduced through the mounting opening into the vacuum cleaner filter bag in such a manner that during operation of the vacuum cleaner it shows the above-described functions and actions.

Figure 4:
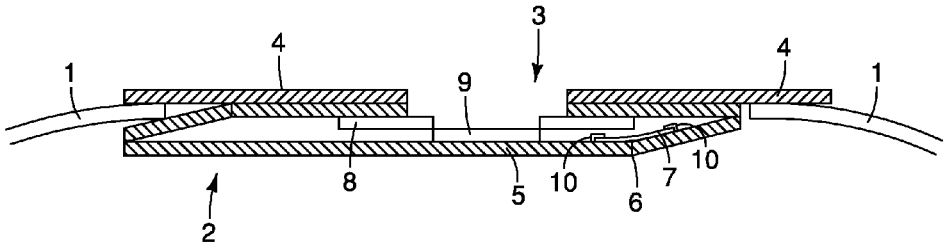
FIG. 4 is a schematic cross-sectional view through a further embodiment of a closing device in the first position according to the present invention.

An example of this embodiment is schematically illustrated in FIG. 4, where like elements are provided with like reference numerals.

In this embodiment, the closing device 2 is introduced in an opened position into the bag 1 and the retaining plate 4 is connected to the outside of the bag. In this case the retaining plate must be somewhat larger than the mounting opening, so that it can be fastened on the outer wall of the bag thereto.

Preferably, the fastening operation is here carried out such that the retaining plate 4 is fastened tightly with respect to the vacuum cleaner filter bag 1. The type of fastening is here chosen in response to the material of the vacuum cleaner filter bag and the retaining device. For instance, but not exclusively, the bag wall and the closing device may be glued or welded, particularly by ultrasound.

In the illustrated embodiment the spring 7 is clamped between two receiving elements 10. Such an arrangement is particularly of advantage in the case of closing devices made from plastics. The spring 7 need here not be glued, so that the spring is arranged to be freely movable and is only retained by the receiving elements 10.

In this embodiment the inlet opening is formed in the retaining plate and preferably provided with a seal 8, so that an airtight closure is ensured between inlet nozzle of the vacuum cleaner and vacuum cleaner filter bag. Depending on the material used for the retaining plate, seals of rubber, foam or similarly suited materials may be used for this purpose.

Apart from the special features ensuing from the second constructional alternative, the vacuum cleaner filter bag may also be configured in the way as has been described with reference to the first constructional alternative. Particularly, the closing device may also be configured in very different ways, particularly as described above in connection with the first constructional alternative.

According to a second embodiment of the second constructional alternative, a mounting opening may be provided in the bag wall, the mounting opening being so large that the closing device taken as such can be fastened to the outside of the bag. Suitable connections, for instance gluing or welding, are here also used for the materials employed for the vacuum filter bag and the closing device.

Finally, the connection between closing device and vacuum cleaner filter bag has mounted thereon a retaining plate of a corresponding size and the retaining plate is fastened to the combination of closing device and vacuum cleaner filter bag. The closing device, in turn, is thereby arranged on the retaining plate.

The features of the vacuum cleaner filter bag that have nothing to do with the special constructional design can again be configured in many ways, as described particularly with reference to the various embodiments of the first constructional alternative and in connection with the first embodiment of the second constructional alternative.

According to a third embodiment of the second constructional alternative, the retaining plate is made from plastics. In this connection it is obvious to configure the closing device as an integral part of the retaining plate, so that the closing device, in turn, is arranged on the retaining plate. Expediently, the forms of retaining plate and closing device have here been chosen such that they can be produced in an injection molding process.

As an alternative to the third variant, retaining device and closing device can also be formed individually in an injection molding process in a fourth embodiment and then be fastened to one another in a suitable way.

The observations made in connection with the first and second embodiment of the second constructional alternative are applicable to both the third and fourth embodiment with respect to an insertion into the dust filter bag and the fastening of the retaining plate with closing device, with respect to the dimensions to be chosen and with respect to the materials used.

The invention claimed is:

1. A vacuum cleaner filter bag comprising an inlet opening, a retaining plate, situated on the exterior of the bag in the vicinity of the inlet opening and configured for attachment to a retaining device of a vacuum cleaner, and a closing device situated in the vicinity of the inlet opening, the closing device having a first position when the vacuum cleaner filter bag is not inserted into the vacuum cleaner, and a second position when the vacuum cleaner bag is inserted into the vacuum cleaner, the closing device in the second position comprises at least one closing surface opposite the inlet opening, wherein the inlet opening is closed in the first position of the closing device and is open in the second position of the closing device, and wherein the closing device in the second position comprises two trapezoidal or rectangular closing surfaces which, starting from the inlet opening, converge towards each other in a wedge and are interconnected at a connection edge opposite the inlet opening.

2. The vacuum cleaner filter bag according to claim 1, wherein the closing device is arranged in an interior of the bag in an area of the inlet opening.

3. The vacuum cleaner filter bag according to claim 1, wherein the closing device is fastened to an inside of the bag or to the exterior of the bag and surrounds the inlet opening at least in part.

4. The vacuum cleaner filter bag according to claim 1, wherein the closing device is arranged on the retaining plate.

5. The vacuum cleaner filter bag according to claim 4, wherein the closing device is fastened to a side of the retaining plate facing the exterior of the bag and surrounds the inlet opening at least in part.

6. The vacuum cleaner filter bag according to claim 1, wherein the closing device comprises a spring element which exerts a restoring force on a part of the closing device such that the closing device adopts the first position when the retaining plate is removed from the retaining device.

7. The vacuum cleaner filter bag according to claim 1, wherein the closing device comprises fold lines or film hinges so that the closing device can be brought from the first position or second position into the second position or first position.

8. The vacuum cleaner filter bag according to claim 1, wherein the closing device is configured such that the first position has reduced extension size in comparison with an extension size in the second position measured in a direction perpendicular to the plane of the inlet opening.

9. The vacuum cleaner filter bag according to claim 1, further comprising at least one sealing element for sealing the inlet opening.

10. The vacuum cleaner filter bag according to claim 9, wherein the at least one sealing element is arranged between the inlet opening and the closing device and/or within the closing device.

11. The vacuum cleaner filter bag according to claim 9, wherein the material of the sealing element comprises rubber, an elastomer, a foil or foam.

12. The vacuum cleaner filter bag according to claim 1, wherein the closing device comprises a substantially airtight material.

13. The vacuum cleaner filter bag according to claim 1, wherein the closing device comprises a plastic material, a dry-laid or wet-laid nonwoven or paper, or a foil.

14. The vacuum cleaner filter bag according to claim 1, wherein the closing device is glued or welded to a filter material of a wall of the vacuum cleaner filter bag and/or the retaining plate.

15. The vacuum cleaner filter bag according to claim 1, wherein the at least one closing surface is arranged at a predetermined angle relative to a plane of the inlet opening.

16. The vacuum cleaner filter bag according to claim 1, wherein the at least one closing surface has an area larger than an area of the inlet opening.

17. A vacuum cleaner filter bag comprising an inlet opening, a retaining plate, situated on the exterior of the bag in the vicinity of the inlet opening and configured for attachment to a retaining device of a vacuum cleaner, and a closing device situated in the vicinity of the inlet opening, the closing device having a first position when the vacuum cleaner filter bag is not inserted into the vacuum cleaner, and a second position when the vacuum cleaner bag is inserted into the vacuum cleaner, the closing device in the second position comprises at least one closing surface opposite the inlet opening, wherein the inlet opening is closed in the first position of the closing device and is open in the second position of the closing device, and wherein the closing device in the second position has the shape of a parallelepiped, which comprises an inflow opening in a first side surface surrounding the inlet opening and connected to an inner surface of the bag, and comprises an outflow opening in at least one further side surface standing on the first side surface.

18. The vacuum cleaner filter bag according to claim 17, wherein each outflow opening occupies the whole side surface of the parallelepiped.

19. The vacuum cleaner filter bag according to claim 17, wherein at least two opposite outflow openings are provided.

20. The vacuum cleaner filter bag according to claim 1, wherein the closing device is configured to deflect an air stream flowing through the inlet opening in the second position.

21. The vacuum cleaner filter bag according to claim 20, wherein the closing device is configured for dividing the air stream into at least two partial streams with different flow directions.

22. The vacuum cleaner filter bag according to claim 1, further comprising a vacuum cleaner for accommodating a vacuum cleaner filter bag, the vacuum cleaner comprising a housing having arranged therein a retaining device adapted to be mounted on the retaining plate of the vacuum cleaner filter bag, wherein the retaining device is configured and/or arranged in the housing such that the closing device of the vacuum cleaner filter bag adopts the second position by attaching the retaining plate to the retaining device.

23. The vacuum cleaner filter bag according to claim 17, wherein the closing device is arranged in an interior of the bag in an area of the inlet opening.

24. The vacuum cleaner filter bag according to claim 17, wherein the closing device is fastened to an inside of the bag or to the exterior of the bag and surrounds the inlet opening at least in part.

25. The vacuum cleaner filter bag according to claim 17, wherein the closing device is arranged on the retaining plate.

26. The vacuum cleaner filter bag according to claim 17, wherein the closing device comprises a spring element which exerts a restoring force on a part of the closing device such that the closing device adopts the first position when the retaining plate is removed from the retaining device.

* * * * *

UNITED STATES PATENT AND TRADEMARK OFFICE

CERTIFICATE OF CORRECTION

PATENT NO. : 8,479,356 B2
APPLICATION NO. : 12/094046
DATED : July 9, 2013
INVENTOR(S) : Sauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1449 days.

Signed and Sealed this
Eighth Day of September, 2015

Michelle K. Lee

Michelle K. Lee
*Director of the United States Patent and Trademark Office*